US009346594B2

(12) United States Patent
Pipes et al.

(10) Patent No.: US 9,346,594 B2
(45) Date of Patent: May 24, 2016

(54) DISPENSING CONTAINER AND RELATED METHOD AND APPARATUS

(71) Applicant: R.J. Reynolds Tobacco Company, Winston-Salem, NC (US)

(72) Inventors: Jerry W. Pipes, Clemmons, NC (US); Wesley S. Jones, Lexington, NC (US)

(73) Assignee: R. J. Reynolds Tobacco Company, Winston-Salem, NC (US)

( * ) Notice: Subject to any disclaimer, the term of this patent is extended or adjusted under 35 U.S.C. 154(b) by 430 days.

(21) Appl. No.: 13/788,832

(22) Filed: Mar. 7, 2013

(65) Prior Publication Data

US 2014/0251842 A1 Sep. 11, 2014

(51) Int. Cl.

| | |
|---|---|
| ***B65D 85/42*** | (2006.01) |
| ***B65D 50/06*** | (2006.01) |
| ***B65D 83/04*** | (2006.01) |

(52) U.S. Cl.

CPC ..... *B65D 50/066* (2013.01); *B65D 83/0463* (2013.01)

(58) Field of Classification Search

USPC ..... 206/528, 534.1, 538

See application file for complete search history.

(56) References Cited

U.S. PATENT DOCUMENTS

| | | | |
|---|---|---|---|
| 3,630,346 | A | 12/1971 | Burnside |
| 3,809,220 | A | 5/1974 | Arcudi |
| 3,835,995 | A | 9/1974 | Haines |
| 3,872,970 | A | 3/1975 | Edison |
| 3,912,081 | A | 10/1975 | Haines et al. |
| 3,921,805 | A | 11/1975 | Compere |
| 3,924,746 | A | 12/1975 | Haines |
| 3,941,248 | A | 3/1976 | Moser et al. |
| 4,011,949 | A | 3/1977 | Braber et al. |
| 4,125,190 | A | 11/1978 | Davie, Jr. et al. |
| 4,231,477 | A | 11/1980 | De Felice |
| 4,243,144 | A | 1/1981 | Margulies |
| 4,280,621 | A | 7/1981 | Tonrey |
| 4,294,361 | A | 10/1981 | Margulies et al. |
| 4,398,635 | A | 8/1983 | Hirt |
| 4,537,312 | A | 8/1985 | Intini |
| 4,781,294 | A | 11/1988 | Croce |
| 4,988,004 | A | 1/1991 | Intini |
| 5,046,618 | A | 9/1991 | Wood |
| 5,088,603 | A | 2/1992 | Kirkpatrick |
| 5,172,812 | A | 12/1992 | Wharton et al. |
| 5,325,968 | A | 7/1994 | Sowden |

(Continued)

OTHER PUBLICATIONS

U.S. Appl. No. 13/538,400, filed Jun. 29, 2012, Pipes.

(Continued)

*Primary Examiner* — Jacob K Ackun

(74) *Attorney, Agent, or Firm* — Womble Carlyle Sandridge & Rice LLP

(57) ABSTRACT

A packaged product assembly is provided. The packaged product assembly may include a tray slidably received in a dispensing container. The tray may be a blister pack including units of a product received in sealed cavities. A locking apparatus may be configured to releasably retain the tray in a locked configuration. The locking apparatus may include one or more locking protrusions that engage corresponding locking apertures in the tray. The locking apparatus may also include buttons positioned on opposing sides of the tray. When the buttons are depressed toward one another, the locking protrusions may move relative to the locking apertures such that the tray is unlocked and may be withdrawn from the dispensing container.

9 Claims, 15 Drawing Sheets

(56) References Cited

U.S. PATENT DOCUMENTS

| | | | | |
|---|---|---|---|---|
| 5,339,960 | A | 8/1994 | Price | |
| 5,358,118 | A | 10/1994 | Thompson et al. | |
| 5,511,665 | A | 4/1996 | Dressel et al. | |
| 5,758,774 | A | 6/1998 | Leblong | |
| 5,775,505 | A | 7/1998 | Vasquez et al. | |
| 5,785,180 | A | 7/1998 | Dressel et al. | |
| 5,894,930 | A | 4/1999 | Faughey et al. | |
| 5,944,191 | A | 8/1999 | Ray et al. | |
| 6,161,699 | A | 12/2000 | Gartland | |
| 6,375,956 | B1 | 4/2002 | Hermelin et al. | |
| 6,394,275 | B1 | 5/2002 | Paliotta et al. | |
| 6,422,391 | B1 | 7/2002 | Swartz | |
| 6,679,382 | B1 | 1/2004 | Kancsar et al. | |
| 6,736,261 | B1 | 5/2004 | Thomas et al. | |
| 7,014,039 | B2 | 3/2006 | Henson et al. | |
| 7,401,702 | B2 | 7/2008 | Hession | |
| D625,178 | S | 10/2010 | Bailey et al. | |
| 7,946,450 | B2 | 5/2011 | Gelardi et al. | |
| 8,033,425 | B2 | 10/2011 | Gelardi | |
| 8,066,123 | B2 | 11/2011 | Gelardi | |
| 8,087,540 | B2 | 1/2012 | Bailey et al. | |
| 8,096,411 | B2 | 1/2012 | Bailey et al. | |
| D658,377 | S | 5/2012 | Corwin et al. | |
| 8,672,134 | B2 * | 3/2014 | Sprada et al. | 206/531 |
| 2005/0183981 | A1 | 8/2005 | Gelardi | |
| 2010/0133140 | A1 | 6/2010 | Bailey et al. | |
| 2010/0300923 | A1 * | 12/2010 | Sack et al. | 206/531 |
| 2011/0000931 | A1 | 1/2011 | Gelardi et al. | |
| 2011/0036743 | A1 * | 2/2011 | Wharton | 206/531 |
| 2011/0186469 | A1 * | 8/2011 | Sack et al. | 206/531 |
| 2012/0285125 | A1 | 11/2012 | Bailey | |

OTHER PUBLICATIONS

U.S. Appl. No. 13/739,776, filed Jan. 11, 2013, Pipes.

Shellpak® Unit of Use Medication Packaging Brochure http://www.meadwestvaco.com/HealthcarePackagingSolutions/SolidOralDoseandAdherence/MWV021960 website visited May 20, 2013.

* cited by examiner

DISPENSING CONTAINER AND RELATED METHOD AND APPARATUS

BACKGROUND OF THE DISCLOSURE

1. Field of the Disclosure

The present disclosure relates to dispensing containers and related methods and apparatuses. More particularly, the present disclosure relates to dispensing containers configured to lock and unlock a slidable tray including products, made or derived from tobacco, or that otherwise incorporate tobacco, and are intended for human consumption.

2. Description of Related Art

Certain consumable products, such as pharmaceutical products, may be preferably stored in packages commonly referred to as "blister packs." Blister packs define a plurality of bubble cavities in which a single unit of product is typically stored. The units of product may be respectively sealed in the cavities. A unit of product is removable from a cavity by applying pressure at one of the cavities to cause the unit of product to rupture the cavity and exit therefrom.

However, blister packs may not be suitable for carrying by a consumer. In this regard, blister packs may define an unergonomic shape that is uncomfortable to hold or inconvenient to store in a pocket or purse. Further, a consumer may desire discretion with respect to the identity of the products in the blister pack. Additionally, it may be possible to accidentally puncture one of the cavities in the blister pack, which may undesirably expose the unit of product to atmospheric conditions or potentially cause loss thereof. Also, existing embodiments of blister packs may offer child-resistance, but the features employed to achieve child-resistance may make the blister packs difficult to use.

Accordingly, there remains a need in the art for a container for storing and dispensing a product, for example from a blister pack.

BRIEF SUMMARY OF THE DISCLOSURE

The above and other needs are met by various aspects of the present disclosure, wherein, in one aspect, an apparatus is provided. The apparatus may comprise a locking protrusion configured to releasably engage an aperture in a tray. A first button and a second button may be configured to receive the tray therebetween. The first button and the second button may be operatively engaged with one of the locking protrusion and the tray such that depressing the first button and the second button inwardly toward the tray adjusts the engagement of the locking protrusion with the tray from a locked configuration in which the locking protrusion engages the aperture in the tray to an unlocked configuration in which the locking protrusion is disengaged from the aperture in the tray and the tray may be slid out from between the first button and the second button.

In some embodiments, depressing the first button and the second button inwardly toward the tray may elastically bend the tray such that the aperture in the tray lifts off of the locking protrusion and disengages therefrom. In further embodiments, depressing the first button and the second button inwardly toward the tray moves the locking protrusion relative to the tray such that the locking protrusion releases from the aperture.

In some embodiments the first button may define a first slot configured to receive a first side edge of the tray and the second button may define a second slot configured to receive a second side edge of the tray. The first slot and the second slot may respectively define an enlarged end and a narrowed end.

The apparatus may further comprise an opposing locking protrusion configured to engage a second aperture in the tray.

In some embodiments the apparatus may further comprise a support structure coupled to the first button, the second button, the locking protrusion, and the opposing locking protrusion. The support structure may be configured to flex when the first button and the second button move toward one another such that the locking protrusion and the opposing locking protrusion move apart from one another. The locking protrusion and the opposing locking protrusion may be displaced from one another along an axis extending between the first button and the second button. In the locked configuration the locking protrusion and the opposing locking protrusion may overlap one another in a direction perpendicular to the axis extending between the first button and the second button. The locking protrusion and the opposing locking protrusion may define angled surfaces configured to contact an end edge of the tray and direct the tray between the locking protrusion and the opposing locking protrusion.

In another aspect, a dispensing container is provided. The dispensing container may comprise a housing defining a chamber configured to slidably receive a tray therein. The dispensing container may also include a locking protrusion extending within the chamber and configured to releasably engage an aperture in the tray. A first button and a second button may be positioned at opposing sides of the housing and configured to receive the tray therebetween. The first button and the second button may be operatively engaged with one of the locking protrusion and the tray such that depressing the first button and the second button toward the tray adjusts the engagement of the locking protrusion with the tray from a locked configuration in which the locking protrusion engages the aperture in the tray to an unlocked configuration in which the locking protrusion is disengaged from the aperture in the tray and the tray may be at least partially slid out from the housing.

In some embodiments the locking protrusion may be defined by the housing. A stop protrusion may be configured to engage a stop aperture in the tray to prevent the tray from being fully removed from the housing. The first button and the second button may be configured to bend the tray when depressed and the locking protrusion may be configured to remain substantially stationary when the first button and the second button are depressed. The locking protrusion may be defined by a longitudinal extension extending into the chamber from a major sidewall of the housing. The dispensing container may comprise a stop protrusion configured to engage a second aperture in the tray to prevent the tray from being fully removed from the housing, wherein the stop protrusion is defined by an opposing longitudinal extension extending into the chamber from an opposing major sidewall of the housing. The opposing longitudinal extension may slope toward the major sidewall proximate an end wall of the housing. In further embodiments, depressing the first button and the second button inwardly toward the tray moves the locking protrusion relative to the tray such that the locking protrusion releases from the aperture.

In some embodiments the dispensing container may further comprise a plurality of rails configured to receive a first side edge and a second side edge of the tray to align the tray with respect to the first button and the second button. A longitudinal extension may extend into the chamber from a major sidewall of the housing and define the locking protrusion and a sliding portion. The longitudinal extension may be configured to support the tray at a first height in the chamber that is greater than a second height in the chamber at which the rails support the tray such that the tray is bent about the longitudinal extension when in the locked configuration.

In some embodiments the dispensing container may be provided in combination with the tray. The tray may define a plurality of sealed cavities in which a plurality of units of a product are received. The product may be selected from the group consisting of pharmaceutical products, smoking products, smokeless tobacco products, consumable products, and combination thereof. In one embodiment the product may be a smokeless tobacco product.

In a further aspect, a method for dispensing a product from a container is provided. The method may comprise providing a dispensing container, such as disclosed herein, that is in combination with a tray. The method further may comprise depressing a first button and a second button on the dispensing container toward the tray so as to adjust the engagement of a locking protrusion with the tray from the locked configuration in which the locking protrusion engages an aperture in the tray to the unlocked configuration in which the locking protrusion is disengaged from the aperture in the tray. The method also may comprise at least partially sliding the tray out from the housing. The method also may comprise removing a product from one of a plurality of sealed cavity in the tray.

In an additional aspect, a method for lockably engaging a tray is provided. The method may include providing a dispensing container. The dispensing container may comprise a housing defining a chamber, a locking protrusion extending within the chamber, and a first button and a second button positioned at opposing sides of the housing, the first button defining a first slot and the second button defining a second slot. The method may additionally include providing a tray defining an aperture and a plurality of sealed cavities in which a plurality of units of a product are received. The method may also include inserting the tray into the chamber such that a first side edge of the tray is received in the first slot in the first button and a second side edge of the tray is received in the second slot in the second button and the locking protrusion engages the aperture in the tray.

In some embodiments inserting the tray into the chamber may comprise sliding the tray along a sliding portion of a longitudinal extension extending into the chamber from a major sidewall of the housing. Inserting the tray into the chamber may comprise bending the tray about the longitudinal extension and retaining the locking projection in a substantially stationary configuration. Inserting the tray into the chamber may include directing an end edge of the tray between the locking protrusion and an opposing locking protrusion and flexing a support structure coupled to the first button, the second button, the locking protrusion while the locking protrusion and the opposing locking protrusion move apart from one another. Further, inserting the tray into the chamber may comprise directing the first side edge and the second side edge of the tray between a plurality of rails configured to align the tray with respect to the first slot in the first button and the second slot in the second button.

Aspects of the present disclosure thus address the identified needs and provide other advantages as otherwise detailed herein.

BRIEF DESCRIPTION OF THE SEVERAL VIEWS OF THE DRAWING(S)

Having thus described the disclosure in general terms, reference will now be made to the accompanying drawings, which are not necessarily drawn to scale, and wherein:

DETAILED DESCRIPTION OF THE PREFERRED EMBODIMENTS

Figure 1:
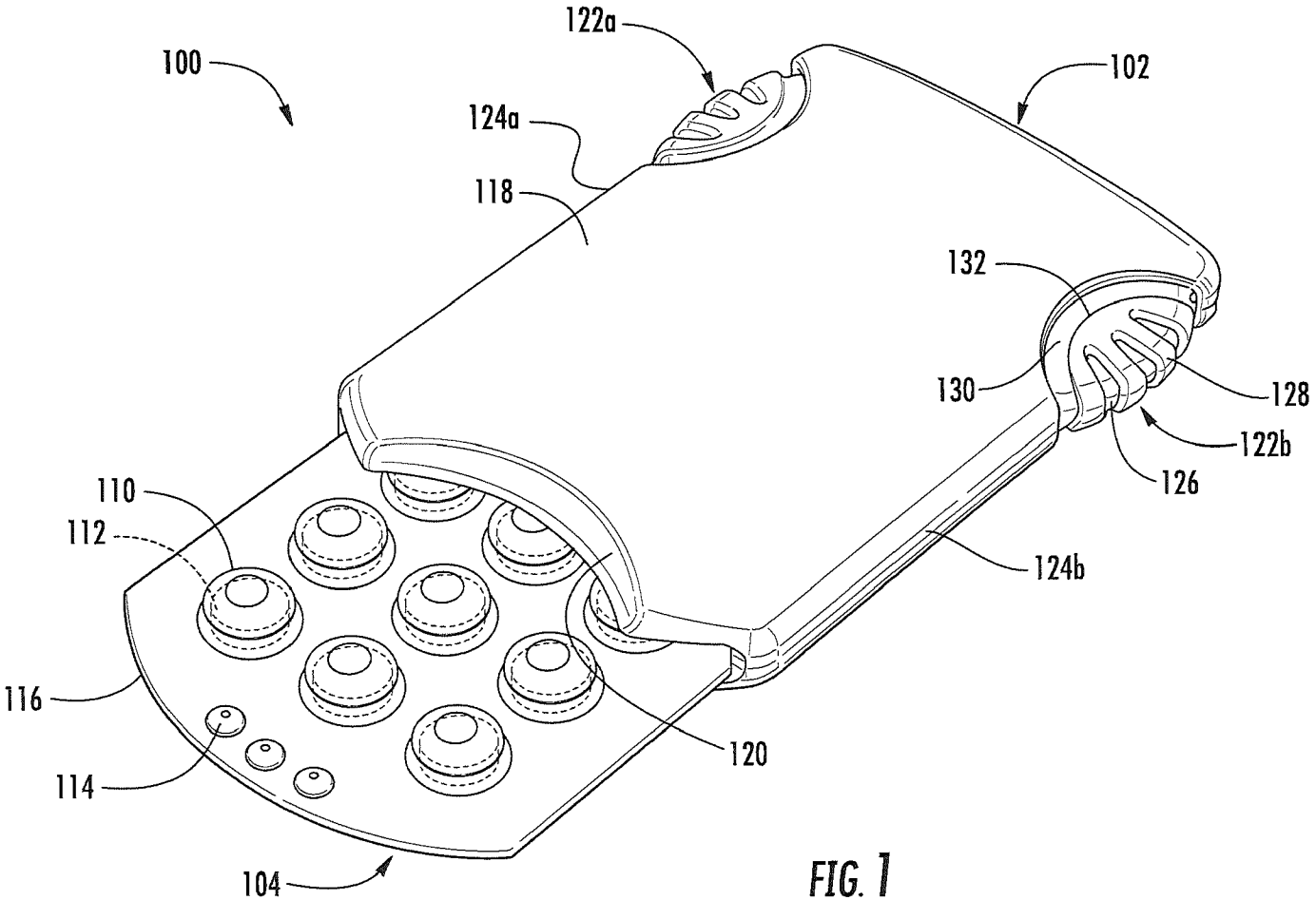
FIG. 1 illustrates a perspective view of a packaged product assembly comprising a tray and a dispensing container according to a first example embodiment of the present disclosure.

The present disclosure now will be described more fully hereinafter with reference to the accompanying drawings, in which some, but not all aspects of the disclosure are shown. Indeed, the disclosure can be embodied in many different forms and should not be construed as limited to the aspects set forth herein; rather, these aspects are provided so that this disclosure will satisfy applicable legal requirements. Like numbers refer to like elements throughout.

As described herein, embodiments of the disclosure relate to apparatuses and methods for dispensing products. In particular, the apparatuses and methods disclosed herein relate to dispensing containers for storing and dispensing units of product from trays. In some embodiments the trays may comprise blister packs. Examples of blister packs and related packaging may be found in the following: U.S. Pat. No. 3,610,410 to Seeley; U.S. Pat. No. 3,689,458 to Hellstrom; U.S. Pat. No. 3,732,663 to Geldmacher et al.; U.S. Pat. No. 3,792,181 to Mahaffy et al.; U.S. Pat. No. 3,812,963 to Zahuranec et al.; U.S. Pat. No. 3,948,394 to Hellstrom; U.S. Pat. No. 3,967,730 to Driscoll et al.; U.S. Pat. No. 4,120,400 to Kotyuk; U.S. Pat. No. 4,169,531 to Wood; U.S. Pat. No. 4,383,607 to Lordahl et al.; U.S. Pat. No. 4,535,890 to Artusi; U.S. Pat. No. 5,009,894 to Hsiao; U.S. Pat. No. 5,033,616 to Wyser; U.S. Pat. No. 5,147,035 to Hartman; U.S. Pat. No.

5,154,293 to Gould; U.S. Pat. No. 5,878,887 to Parker et al.; and U.S. Pat. No. 6,520,329 to Fuchs et al., and U.S. Patent Application Publication Nos. 2011/0011756 to Bellamah et al.; 2011/0049003 to Bellamah et al.; 2011/0155796 to Moore et al.; and 2011/0264153 to Bellamah et al., each of which is incorporated herein by reference. Examples of blister packs and related packaging including child-resistant features may be found in the following: U.S. Pat. No. 3,630,346 to Burnside; U.S. Pat. No. 3,809,220 to Arcudi et al.; U.S. Pat. No. 3,835,995 to Haines et al.; U.S. Pat. No. 3,872,970 to Edison; U.S. Pat. No. 3,912,081 to Haines et al.; U.S. Pat. No. 3,921,805 to Compere et al.; U.S. Pat. No. 3,924,746 to Haines et al.; U.S. Pat. No. 3,941,248 to Moser et al.; U.S. Pat. No. 4,011,949 to Braber et al.; U.S. Pat. No. 4,125,190 to Davie, Jr. et al.; U.S. Pat. No. 4,231,477 to Felice; U.S. Pat. No. 4,243,144 to Margulies; U.S. Pat. No. 4,280,621 to Tonrey; U.S. Pat. No. 4,294,361 to Margulies et al.; U.S. Pat. No. 4,398,635 to Hirt; U.S. Pat. No. 4,537,312 to Intini; U.S. Pat. No. 4,781,294 to Croce; U.S. Pat. No. 4,988,004 to Intini; U.S. Pat. No. 5,046,618 to Wood; U.S. Pat. No. 5,088,603 to Kirkpatrick; U.S. Pat. No. 5,172,812 to Wharton et al.; U.S. Pat. No. 5,325,968 to Sowden; U.S. Pat. No. 5,339,960 to Price; U.S. Pat. No. 5,358,118 to Thompson et al.; U.S. Pat. No. 5,511,665 to Dressel et al.; U.S. Pat. No. 5,758,774 to Leblong; U.S. Pat. No. 5,775,505 to Vasquez et al.; U.S. Pat. No. 5,785,180 to Dressel et al.; U.S. Pat. No. 5,894,930 to Faughey et al.; U.S. Pat. No. 5,944,191 to Ray et al.; U.S. Pat. No. 6,161,699 to Gartland; U.S. Pat. No. 6,375,956 to Hermelin et al.; U.S. Pat. No. 6,394,275 to Paliotta et al.; U.S. Pat. No. 6,422,391 to Swartz; U.S. Pat. No. 6,679,382 to Kancsar et al.; and U.S. Pat. No. 7,401,702 to Hession, each of which is incorporated herein by reference.

By employing a dispensing container to store the blister pack, the blister pack may be stored in a convenient form factor that may prevent accidental puncture of the sealed cavities of the blister pack and/or provide other functionality. Examples of containers configured for dispensing units of a product from blister packs may be found in the following: U.S. Pat. No. 3,380,578 to Sparks; U.S. Pat. No. 3,968,880 to Ostrowsky; U.S. Pat. No. 5,878,887 to Parker et al.; U.S. Pat. No. 6,349,831 to Buss; U.S. Pat. No. 6,460,693 to Harrold; U.S. Pat. No. 6,540,081 to Balz et al.; U.S. Pat. No. 6,679,381 to Bush; and U.S. Pat. No. 7,481,331 to Webster et al.; U.S. Patent Application Publication Nos. 2010/0264153 to Bellamah et al.; 2011/0011756 to Bellamah; 2011/0049003 to Bellamah et al.; 2011/0272323 to Ziemba et al.; and 2012/0061396 to Ortenzi et al.; and U.S. patent application Ser. No. 13/538,400 to Pipes et al., filed Jun. 29, 2012, each of which is incorporated herein by reference.

However, existing embodiments of blister packs may not offer a level of convenience and, optionally, a level of child-resistance that is desirable. In this regard, users may prefer the convenience and ease-of-use associated with dispensing containers including slidable trays. By way of example, U.S. Pat. No. 7,946,450 and U.S. Patent Application Publication No. 2011/0000931 to Gelardi et al., which are incorporated herein by reference, describe dispensing containers with a tray including a stack of products slidably received in a housing and including child-resistant features. U.S. Pat. No. 8,096,411 to Bailey et al., which is incorporated herein by reference, describes a dispensing container with a tray including loose products slidably received in a housing and including child-resistance features. U.S. Patent Application Publication No. 2010/0133140 to Bailey et al. and U.S. Pat. No. 8,066,123 to Gelardi, which are incorporated herein by reference, describe dispensing containers with a slidable tray including multiple compartments configured to hold products and including child-resistant features. However, improved ergonomics, child-resistance, and/or the ability to store and dispense from a blister pack may still be desirable.

Accordingly, embodiments of the present disclosure are directed to providing a child-resistant dispensing container configured to conveniently slidably provide access to a blister pack. In this regard, FIG. 1 illustrates a first embodiment of a packaged product assembly 100. The packaged product assembly 100 includes a dispensing container 102 and a tray 104 slidably received therein.

Figure 2:
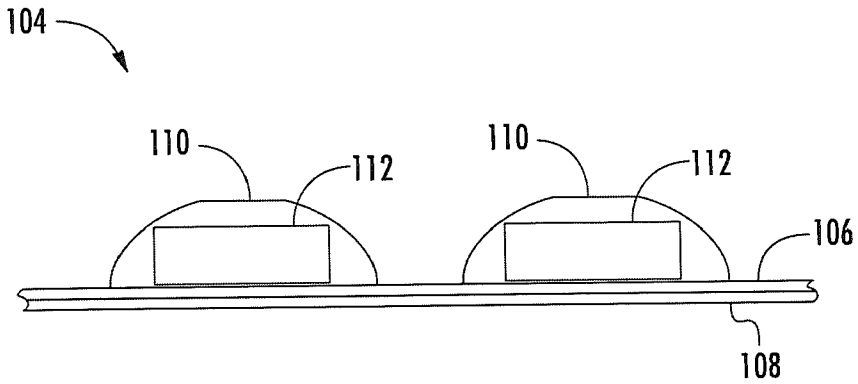
FIG. 2 illustrates a partial side view of the tray of FIG. 1.
Figure 3:
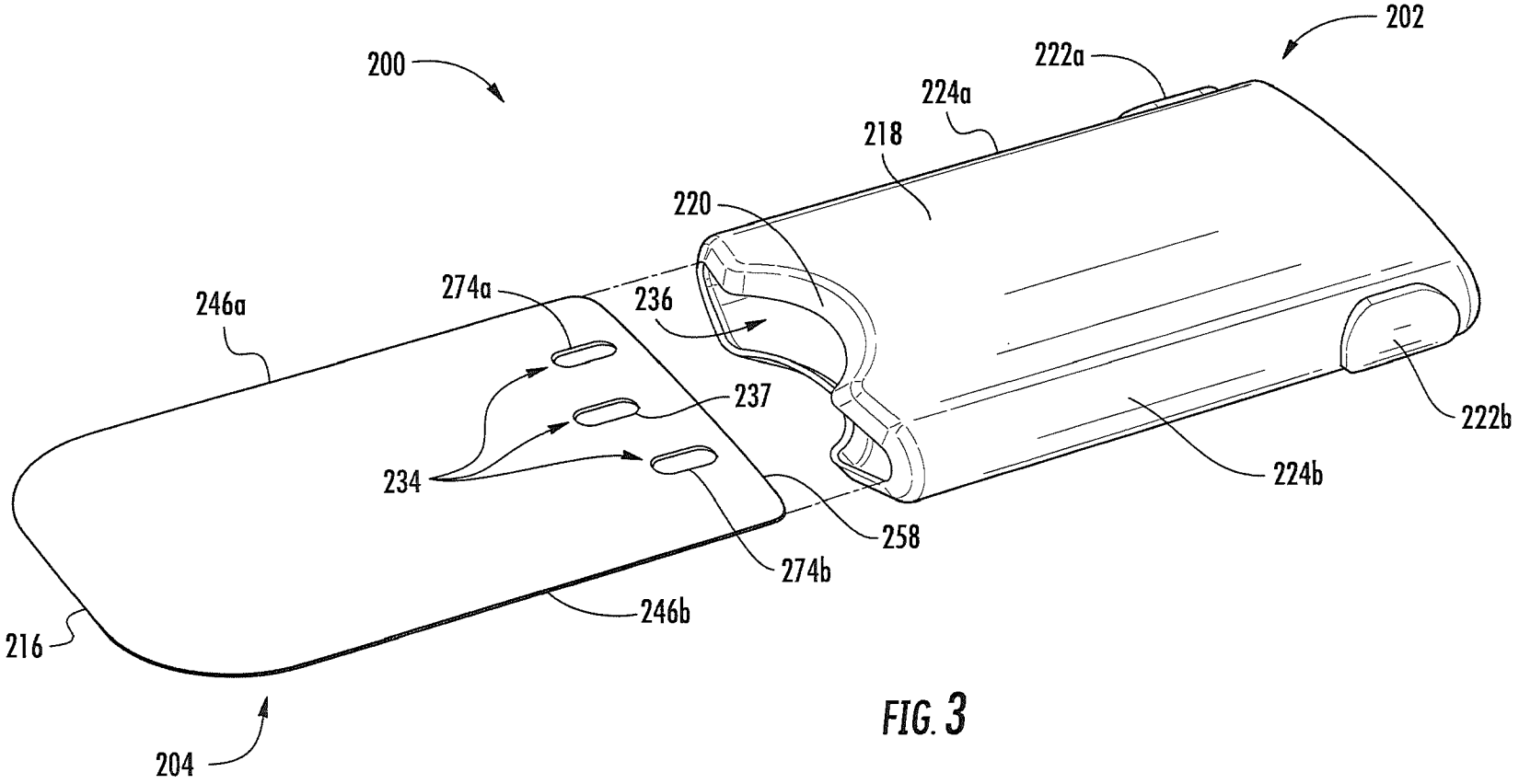
FIG. 3 illustrates a perspective view of a packaged product assembly comprising a tray and a dispensing container including a locking apparatus in an unassembled configuration according to a second example embodiment of the present disclosure.

As illustrated, the tray 104 may comprise a blister pack. An enlarged partial side view of the tray 104 is illustrated in FIG. 2. The tray 104 may comprise a displaceable layer 106 and a rupturable layer 108. The displaceable layer 106 may comprise a plastic material in one embodiment, which may be translucent or transparent to allow a user to see therethrough. The rupturable layer 108 may comprise, for example, a foil material or a plastic material.

The displaceable layer 106 and the rupturable layer 108 may collectively define a plurality of sealed cavities 110. In particular, the displaceable layer 106 may form a plurality of bubble shapes, and the rupturable layer 108 may define a substantially planar configuration and seal shut each of the sealed cavities 110 in one embodiment. A plurality of units of a product 112 may be received in the sealed cavities 110. For example, as illustrated, one unit of product 112 may be received in each sealed cavity 110.

The product 112 may comprise a variety of substances in a variety of forms. In some embodiments the product 112 may be selected from the group consisting of pharmaceutical products (e.g., nicotine containing lozenges, nicotine containing gums, nicotine containing pouches, and the like), smokeless tobacco products, smoking products (e.g., cartridges or components of electronic cigarettes), and other consumable products. Non-limiting examples of embodiments wherein the product 112 may be a smokeless tobacco product include snus, tobacco tablets, molded powdered tobacco, and further products incorporating tobacco or a tobacco derivative, such as a tobacco extract. In some embodiments the product 112 may be characterized by a shape selected from the group consisting of pill, tablet, orb, sphere, coin, cube, bead, ovoid, obloid, bean, stick, and rod, although the product may be characterized by various other embodiments of shapes. Additional example embodiments of products that may be included in the sealed cavities are described in U.S. Pat. No. 7,946,295 to Brinkley et al. and U.S. Patent Application Publication Nos. 2011/0232662 to Liu et al.; 2011/0247640 to Beeson et al.; 2012/0055494 to Hunt et al.; 2012/0118310 to Cantrell et al.; 2012/0138073 to Cantrell et al.; and 2012/0138074 to Cantrell et al., each of which is incorporated herein by reference.

Returning to FIG. 1, as illustrated, in some embodiments the tray 104 may additionally comprise one or more nubs 114 or other features configured to provide a user with a graspable surface. In one embodiment the nubs 114 may comprise a rubber material or other material configured to enhance grip. As illustrated, the nubs 114 may be positioned proximate an outer end edge 116 of the tray 104. In this regard, the tray 104 may be slidably received in the dispensing container 102 such that it is movable between recessed and extended positions. For example, the tray 104 is illustrated in a partially recessed/partially extended configuration in FIG. 1.

The dispensing container 102 may include a housing 118 in which a cutout 120 may be defined. The cutout 120 may provide access to a portion of the tray 104 when the tray is in the recessed position. In particular, the cutout 120 may be configured to align with the nubs 114 when the tray 104 is in the recessed position. Thereby, the user may grasp the tray 104 proximate the outer end edge 116 thereof. Accordingly, the tray 104 may be conveniently moved between the recessed and extended positions. In the extended (or partially extended) position, the units of the product 112 may be removed from the sealed cavities 110 by depressing the displaceable layer 106 at one of the sealed cavities to rupture the rupturable layer 108 of the tray 104 and cause a unit of product to fall therefrom.

However, in order to prevent access to the products 112 in the tray 104 by a child and/or prevent unintentional movement of the tray from the recessed position to the extended position, the packaged product assembly 100 may include features configured to releasably lock the tray 104 in the recessed position. In this regard, the dispensing container 102 may include a first button 122*a* and a second button 122*b* (collectively, "buttons 122"). The buttons 122 may be disposed at first and second opposing sides 124*a*, 124*b* (collectively, "opposing sides 124") of the housing 118. As discussed below, depressing the buttons 122 inwardly toward one another may be configured to release the tray 104 from a locked configuration within the dispensing container 102. The buttons 122 may comprise grooves 126 and protrusions 128 configured to provide a user with grip when depressing the buttons. Further, in some embodiments the buttons 122 may comprise a recessed section 130 that allows the buttons to move inwardly into the dispensing container 102, and a lip 132 may limit the inward travel thereof into the dispensing container.

Various embodiments of locking apparatuses may be employed to releasably lock the tray in the dispensing container. One example embodiment of a locking apparatus is illustrated in conjunction with a packaged product assembly 200 in FIGS. 3-9. The packaged product assembly 200 may include some or all of the features previously described with respect to the packaged product assembly 100 illustrated in FIG. 1. In this regard, the packaged product assembly 200 comprises a dispensing container 202 and a tray 204. The dispensing container 202 comprises a housing 218 including a cutout 220 and a first button 222*a* and a second button 222*b* (collectively, "buttons 222") disposed at first and second opposing sides 224*a*, 224*b* (collectively, "opposing sides 224") of the housing. The tray 204 may comprise a blister pack as described above. However, the sealed cavities and products are not shown for clarity purposes. As further illustrated in FIG. 1, the tray 204 may include a plurality of apertures 234. One or more of the apertures 234 may be configured to releasably engage a locking apparatus.

Figure 4:
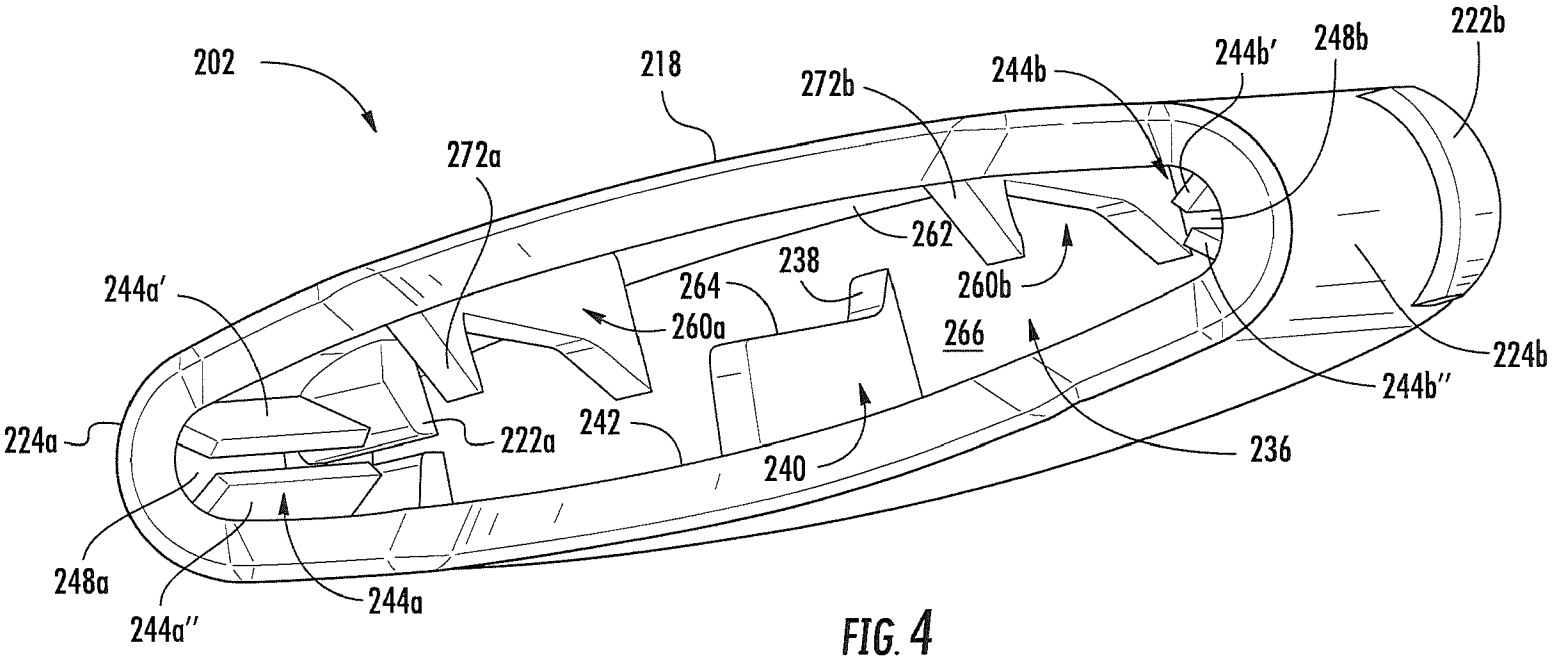
FIG. 4 illustrates a perspective view of the dispensing container of FIG. 3.

In this regard, as illustrated in FIG. 4, the housing 218 of the dispensing container may define a chamber 236 configured to slidably receive the tray 204 therein. A locking protrusion 238 may extend within the chamber 236. In the illustrated embodiment the locking protrusion 238 is defined by the housing 218. More particularly, the locking protrusion 238 is defined by a longitudinal extension 240 extending into the chamber 236 from a major sidewall 242 of the housing 218. However, the locking protrusion may be a separate component in other embodiments. The locking protrusion 238 may be configured to releasably engage one of the apertures 234 in the tray. In the illustrated embodiment (see, e.g., FIG. 3), a central locking aperture 237 is configured for engagement with the locking protrusion 238.

In order to reach the locked configuration, the tray 204 is slid into the chamber 236 defined by the housing 218. The tray 204 may include first and second pairs of rails 244*a*, 244*b* (collectively, "rails 244") configured to receive a first side edge 246*a* and a second side edge 246*b* (collectively, "side edges 246") of the tray 204. More particularly, the rails 244 may include a first pair of rails 244*a* configured to receive the first side edge 246*a* of the tray 204 therebetween, and a second pair of rails 244*b* configured to receive the second side edge 246*b* of the tray therebetween. Each pair of rails 244*a*, 244*b* may include an upper rail 244*a*', 244*b*' and a lower rail 244*a*", 244*b*" configured to receive the side edges 246 of the tray 204 therebetween.

In this illustrated embodiment the rails 244 extend substantially perpendicularly from curved portions of the housing 218 at the opposing sides 224 thereof. In this regard, the upper rails 244*a*', 244*b*' may define an angle with respect to the lower rails 244*a*", 244*b*". Accordingly, as a result of this configuration, each pair of rails 244*a*, 244*b* may define a cavity 248*a*, 248*b* (collectively, "cavities 248") that is substantially triangular in shape and increases in height away from the center of the chamber 236. The triangular shape of the cavities 248 may allow room for the side edges 246 of the tray 204 to angle upwardly and/or downwardly when the tray bends, as discussed below.

Figure 5:
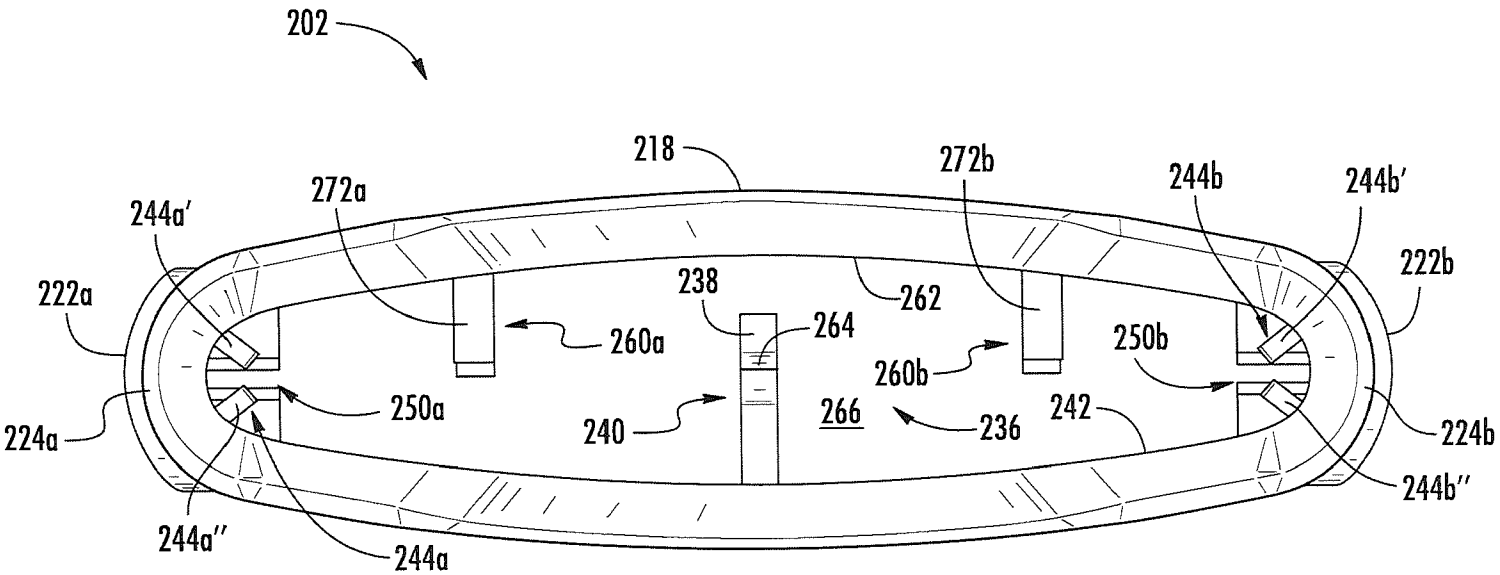
FIG. 5 illustrates an end view of the dispensing container of FIG. 3.

As illustrated in FIG. 5, the rails 244 may also be configured to align the tray 204 with respect to the buttons 222. In this regard, the buttons 222 may be configured to receive the tray 204 therebetween when the tray slides into the locked configuration. The buttons 222 may define features configured to facilitate receipt of the tray 204 therebetween.

Figure 6:
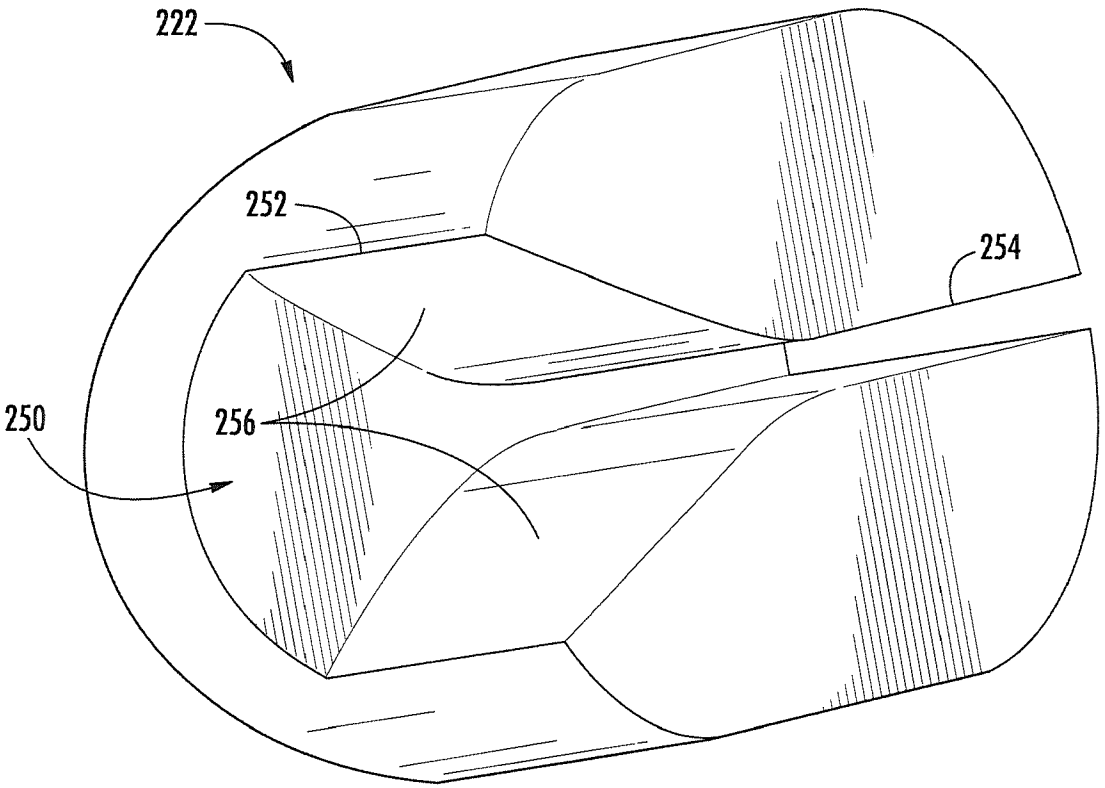
FIG. 6 illustrates a perspective view of a button of the dispensing container of FIG. 3.

In this regard, FIG. 6 illustrates a view of one of the buttons 222. As illustrated, the buttons 222 may each include a slot 250*a*, 250*b* (collectively, "slots 250") configured to receive the side edges 246 of the tray 204. The slots 250 may each define an enlarged end 252*a*, 252*b* (collectively, "enlarged ends 252") and a narrowed end 254*a*, 254*b* (collectively, "narrowed ends 254"). The enlarged ends 252 may include angled surfaces 256*a*, 256*b* (collectively, "angled surfaces 256") configured to direct an inner end edge 258 of the tray 204 (see, e.g., FIG. 3) therebetween and into the narrowed ends 254 of the slot 250. Accordingly, despite any misalignment between the side edges 246 of the tray 204 and the narrowed ends 254 of the slots 250, the angled surfaces 256 at the enlarged ends 252 of the slots may direct the tray therein.

As illustrated in FIG. 5, the dispensing container 202 may additionally include first and second opposing longitudinal extensions 260*a*, 260*b* (collectively, "opposing longitudinal extensions 260") which oppose the longitudinal extension 240. The opposing longitudinal extensions 260 may extend into the chamber 236 from an opposing major sidewall 262 of the housing 218. Thus, the tray 204 may be slidably received between the longitudinal extension 240 extending from the major side sidewall 242 and the opposing longitudinal extensions 260 extending from the opposing major sidewall 262.

Figure 7:
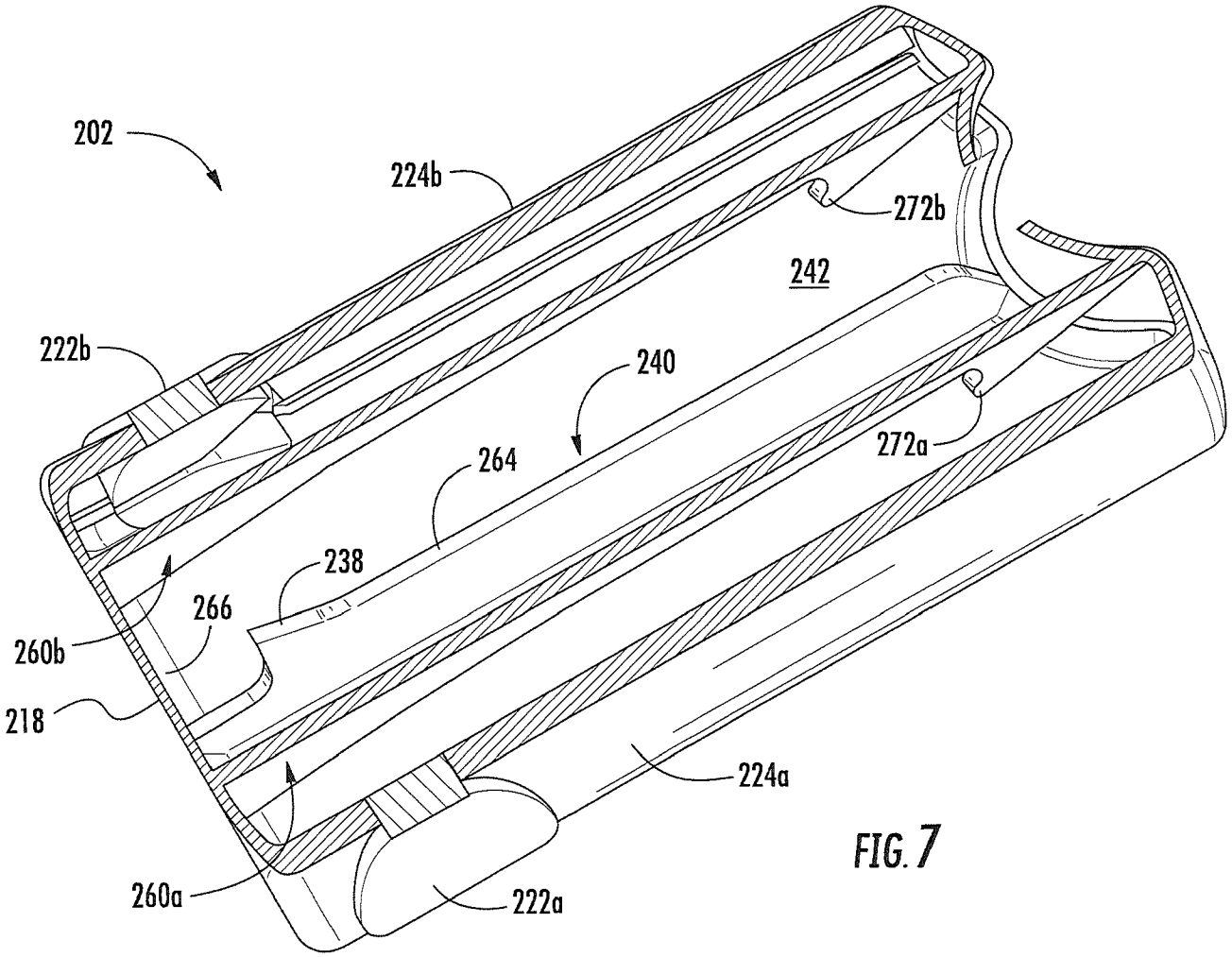
FIG. 7 illustrates a perspective cutaway view of the dispensing container of FIG. 3.

More particularly, as the tray 204 is received in the chamber 236 between the longitudinal extension 240 and the opposing longitudinal extensions 260, the tray may slide along a sliding portion 264 of the longitudinal extension. The tray 204 may be elastically bent upwardly by the locking protrusion 238 before the locking aperture 237 engages therewith. In order to allow the locking aperture 237 to engage the locking protrusion 238, the locking protrusion may be displaced from an end wall 266 of the housing 218, as illustrated in FIG. 7, which is a cutaway view of the dispensing container 202. Thereby, a portion of the tray 204 between the locking aperture 237 and the inner end edge 258 may be received between the locking protrusion 238 and the end wall 266 of the housing 218.

Figure 8:
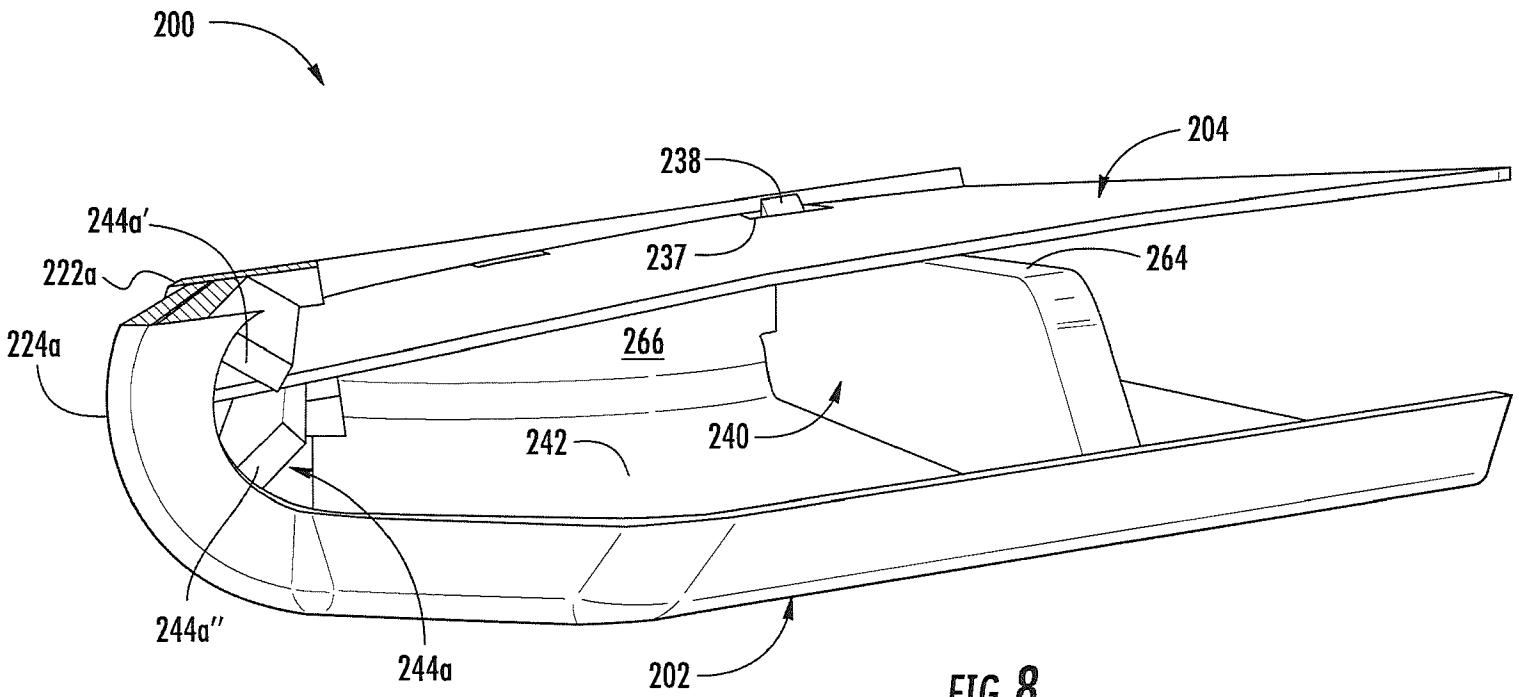
FIG. 8 illustrates a perspective cutaway view of the packaged product assembly of FIG. 3 in a locked configuration.

Further, the longitudinal extension 240 may be configured to support the tray 204 at a first height in the chamber 236 (e.g., with respect to the major wall 242) that is greater than a second height in the chamber (e.g., with respect to the major wall) at which the rails 244 support the side edges 246 of the tray such that the tray is bent about the longitudinal extension when in the locked configuration. For example, FIG. 8 illustrates a cutaway view of the packaged product assembly 200 with the tray 204 in the locked configuration and bent about the longitudinal extension 240. In the locked configuration movement of the tray 204 outwardly from the chamber 236 defined by the housing 218 of the dispensing container 202 may be resisted. More particularly, interference fit between the locking protrusion 238 and the locking aperture 237 may prevent, or at least resist, movement of the tray 204 outwardly from the dispensing container 202.

Figure 9:
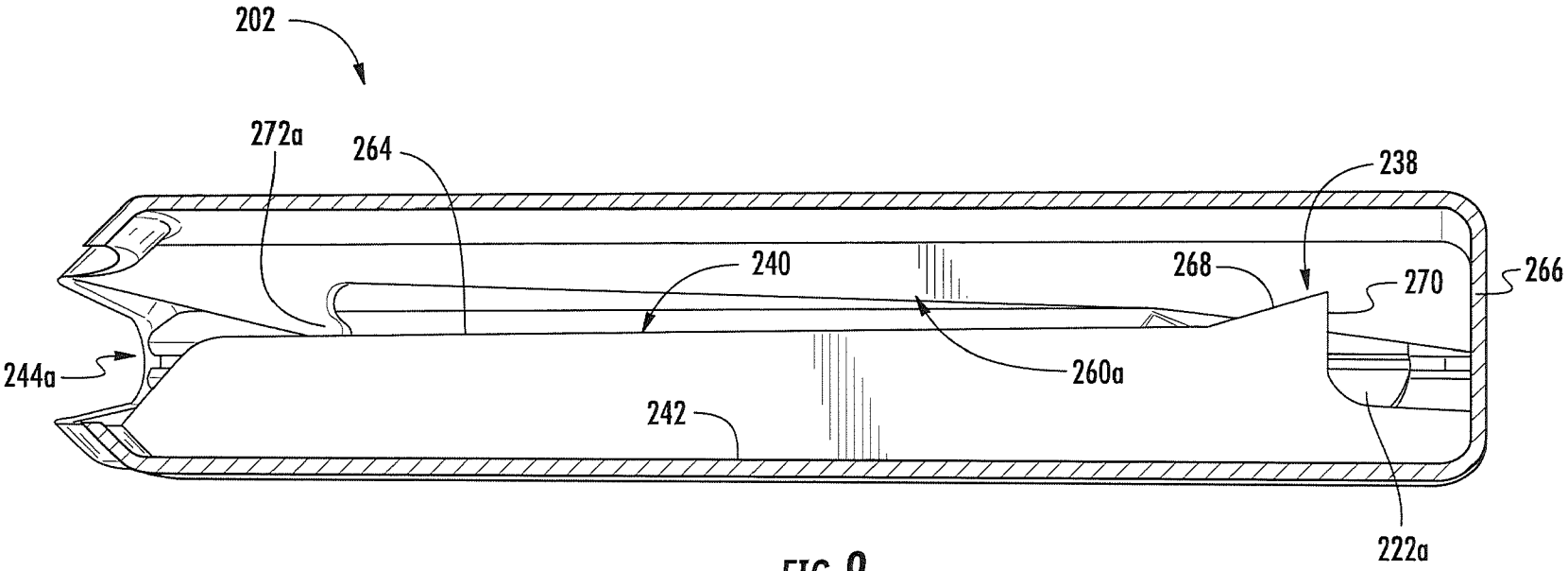
FIG. 9 illustrates a side sectional view through the dispensing container of FIG. 3.

In this regard, as illustrated in FIG. 9, whereas a front portion 268 of the locking protrusion 238 may define an angled surface configured to allow the tray 204 to slide over and into engagement the locking protrusion, a rear portion 270 of the locking aperture may define a surface that is substantially perpendicular to the major sidewall 242 and hence configured to prevent movement of the tray from the chamber 236, except when released as described below. As further illustrated in FIG. 9, the opposing longitudinal extensions 260 may slope toward the major sidewall 242 proximate the end wall 266 of the housing 218. In this regard, by sloping in a direction toward the major sidewall 242, the opposing longitudinal extensions 260 may be configured retain the tray 204 in engagement with the locking protrusion 238 by pressing the tray against the locking protrusion on opposing sides thereof. Accordingly, the tray 204 may be retained in the locked configuration.

However, the buttons 222 may be operatively engaged with the tray 204 such that depressing the buttons toward the tray and one-another moves the tray relative to the locking protrusion 238 from a locked configuration in which the locking protrusion engages the locking aperture 237 in the tray to an unlocked configuration in which the locking protrusion releases from the aperture in the tray and the tray may be at least partially slid out from the housing 218. In this regard, as described above, the side edges 246 of the tray 204 may be received in the slots 250 in the buttons 222. Since the tray 204 may be bent in the locked configuration, as described above and illustrated in FIG. 8, depressing the buttons 222 may cause the tray to further elastically bend in the same direction such that the locking aperture 237 lifts off of the locking protrusion 238 and disengages therefrom. The locking protrusion 238 may remain substantially stationary during this operation, with the tray 204 disengaging therefrom.

Thereby, the user may simultaneously grasp an outer end edge 216 of the tray 204 and pull the tray outwardly from the housing 218 while the buttons 222 are depressed. In some embodiments the buttons 222 must be simultaneously depressed and the tray 204 must be pulled outwardly therefrom with the buttons remaining depressed at least initially during the outward pulling motion to disengage the locking protrusion 238 from the locking aperture 237 in the tray. Accordingly, the packaged product assembly 200 may be provided with a degree of child resistance.

Thus, the tray 204 may be slid out of the chamber 236 and units of a product stored in the tray may be retrieved therefrom, as described above. However, it may be desirable to prevent the tray 204 from being fully removed from the housing 218 such that it may be conveniently slid back into the housing after retrieval of one or more units of product. In this regard, the dispensing container 202 may comprise a first stop protrusion 272*a* and a second stop protrusion 272*b* (collectively, "stop protrusions 272") configured to prevent the tray 204 from being fully removed from the housing 218. In the illustrated embodiment the stop protrusions 272 are defined by the opposing longitudinal extensions 260.

In this regard, the tray 204 may define a first stop aperture 274*a* and a second stop aperture 274*b* (collectively, "stop apertures 274"). The stop protrusions 272 may engage the stop apertures 274 as the tray 204 is slid outwardly from the housing 218. As illustrated in FIG. 9, the stop protrusions 272, which may be hook shaped, may be configured to overlap with the first longitudinal extension 240 in a direction perpendicular to a sliding direction of the tray 204 such that the stop protrusions may be forced into engagement with the stop apertures 274. Accordingly, the stop protrusions 272 may resist or prevent removal of the tray 204 from the housing 218.

Accordingly, the packaged product assembly 200 described above and illustrated in FIGS. 3-9 includes a locking apparatus configured to releasably retain the tray 204 in a locked configuration. The locking apparatus comprises the buttons 222 that are configured to operatively engage the tray 204 to bend the tray such that it releases from the locking protrusion 238. However, the dispensing containers disclosed herein may comprise various other embodiments of locking apparatuses.

Figure 10:
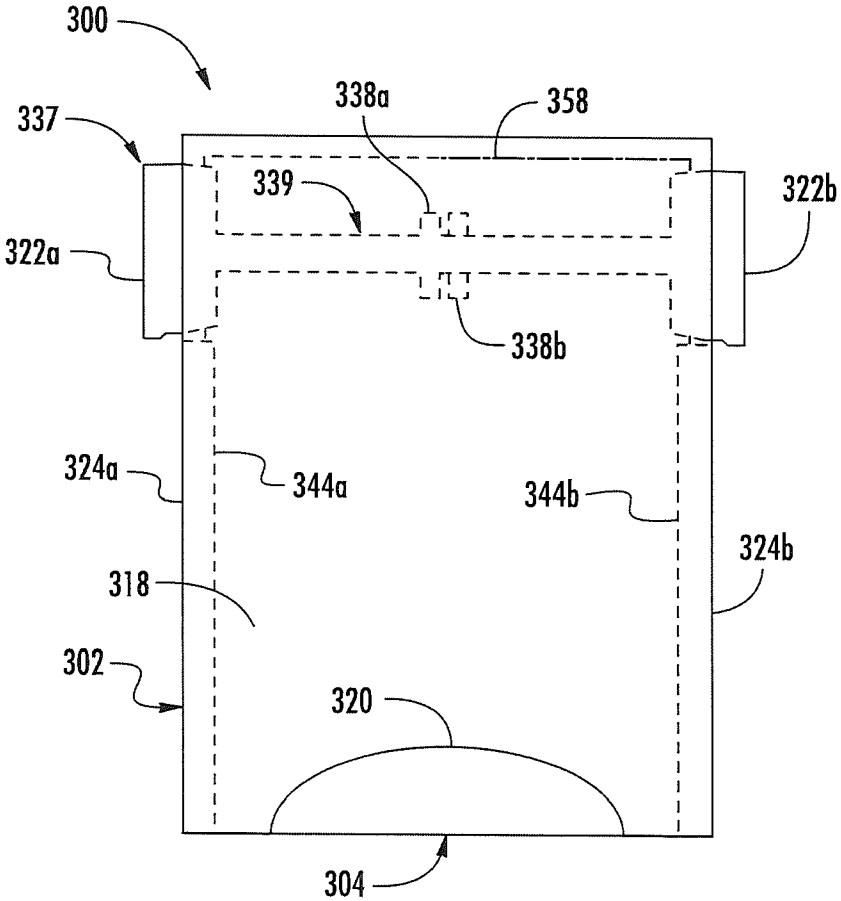
FIG. 10 illustrates an embodiment of a packaged product assembly comprising a tray and a dispensing container including a locking apparatus in a locked configuration according to a third example embodiment of the present disclosure.

For example, FIG. 10 illustrates an alternate embodiment of a packaged product assembly 300. The packaged product assembly 300 may include some of the features included in the above-described packaged product assemblies 100, 200. In this regard, the packaged product assembly 300 comprises a dispensing container 302 and a tray 304. The dispensing container 302 comprises a housing 318 including a cutout 320. Further, the dispensing container 302 comprises a first button 322*a* and a second button 322*b* (collectively, "buttons 322") disposed at first and second opposing sides 324*a*, 324*b* (collectively, "opposing sides 324") of the housing 318.

Figure 11:
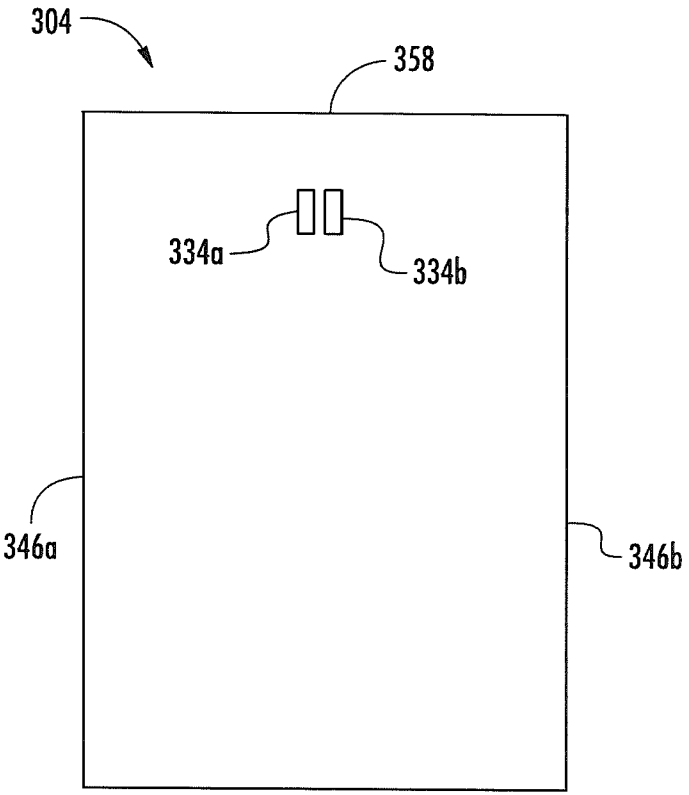
FIG. 11 illustrates a top view of the tray of FIG. 10.

The tray 304 may comprise a blister pack in some embodiments as described above. However, the sealed cavities and products are not shown for clarity purposes. As illustrated in FIG. 11, the tray 304 may include one or more locking apertures, including for example, a first locking aperture 334*a* and a second locking aperture 334*b* (collectively, "locking apertures 334"). The locking apertures 334 may be configured to releasably engage a locking apparatus.

Figure 12:
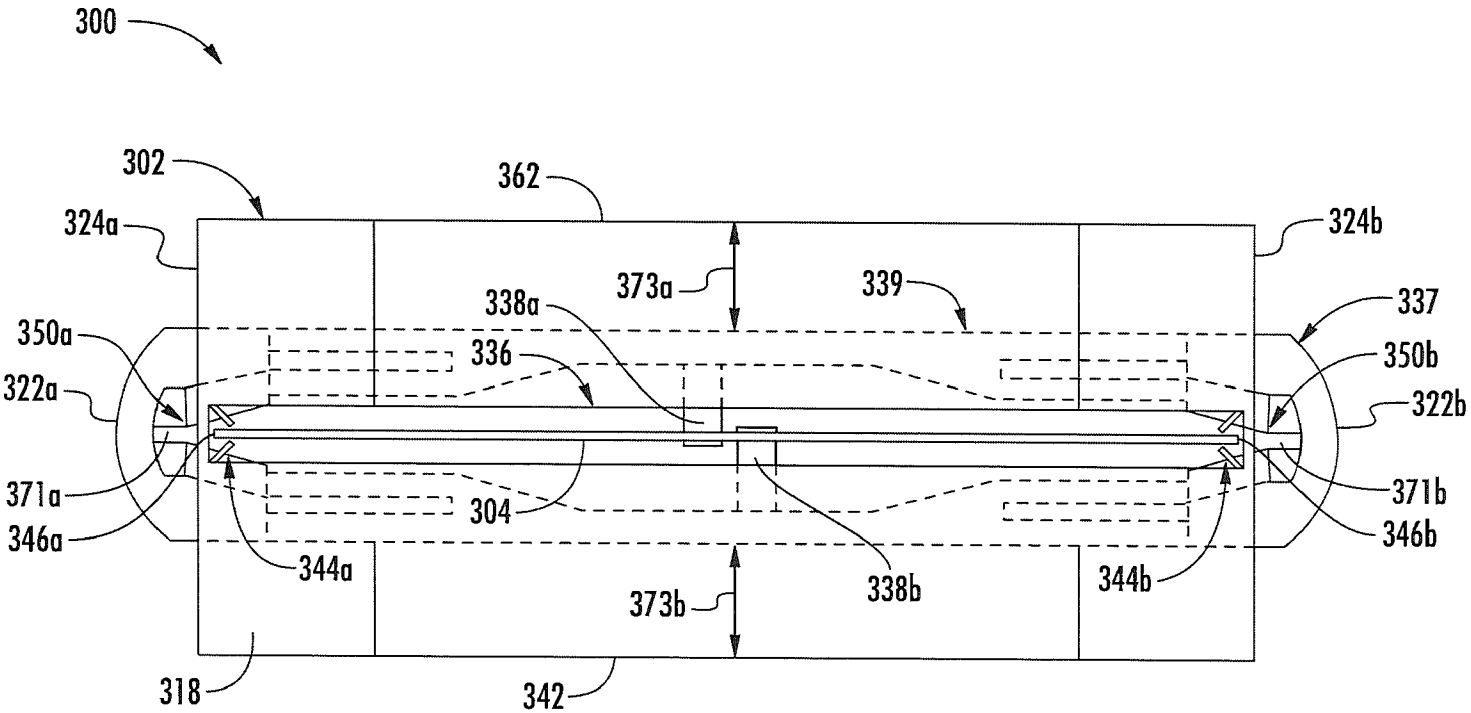
FIG. 12 illustrates an end view of the packaged product assembly of FIG. 10.

In this regard, as illustrated in FIG. 12, the housing 318 of the dispensing container 302 may define a chamber 336 configured to slidably receive the tray 304 therein. A locking apparatus 337 may releasably lock the tray 304 therein. The locking apparatus 337 may comprise one or more locking protrusions including, for example, a locking protrusion 338*a* and an opposing locking protrusion 338*b* (collectively, "locking protrusions 338") that extend within the chamber 336. The locking protrusion 338*a* and the opposing locking protrusion 338*b* may be configured to respectively releasably engage the first locking aperture 334*a* and the second locking aperture 334*b*.

The locking protrusions 338 may differ from the above-described embodiment of the locking protrusion 238 in that the locking protrusions 338 may be defined by or otherwise coupled to a support structure 339, as opposed to defined by the housing 318. Additionally, the support structure 339 may be integral with, or coupled to, the buttons 322. The support structure 339 may be configured to flex, as described below.

In order to reach the locked configuration, the tray 304 may be slid into the chamber 336 defined by the housing 318. In some embodiments the dispensing container 302 may include first and second pairs of rails 344*a*, 344*b* (collectively, "rails 344") configured to respectively receive a first side edge 346*a* and a second side edge 346*b* (collectively, "side edges 346") of the tray 304. More particularly, the rails 344 may include a first pair of rails 344*a* configured to receive the first side edge 346*a* of the tray 304 therebetween, and a second pair of rails 344*b* configured to receive the second side edge 346*b* of the tray therebetween. Each pair of rails 344*a*, 344*b* may include an upper rail and a lower rail configured to receive the side edges 346 of the tray 304 therebetween, as described above.

As illustrated in FIG. 12, the rails 344 may be configured to align the tray 304 with respect to the buttons 322. In this regard, the buttons 322 may be configured to receive the tray 304 therebetween when the tray slides into the locked configuration. The buttons 322 may define features configured to facilitate receipt of the tray 304 therebetween.

Figure 13:
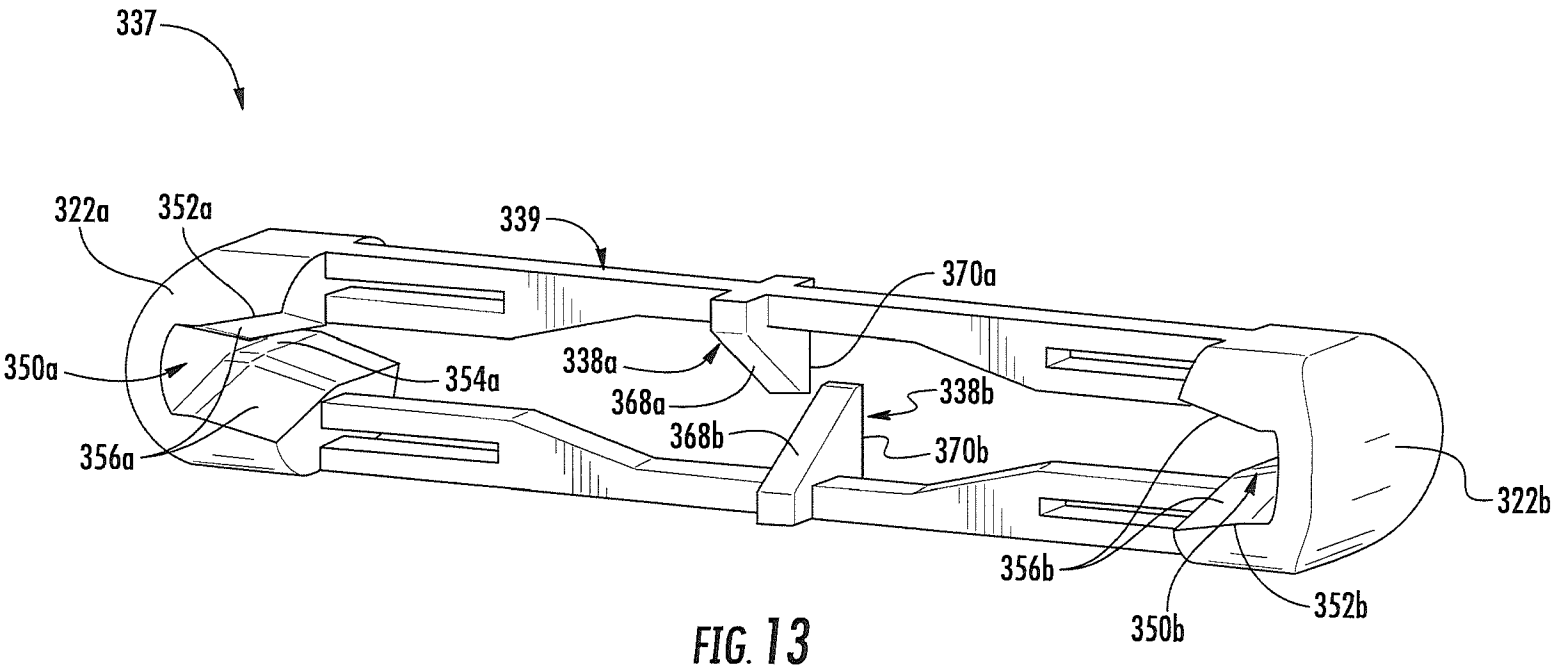
FIG. 13 illustrates a perspective view of the locking apparatus of the dispensing container of FIG. 10.

In this regard, FIG. 13 illustrates a perspective view of the locking apparatus 337 in isolation. As illustrated, the buttons 322 may each include a slot 350*a*, 350*b* (collectively, "slots 350") configured to receive the side edges 346 of the tray 304. The slots 350 may each define an enlarged end 352*a*, 352*b* (collectively, "enlarged ends 352") and a narrowed end 354*a*, 354*b* (collectively, "narrowed ends 354"). The enlarged ends 352 may include angled surfaces 356*a*, 356*b* (collectively, "angled surfaces 356") configured to direct an inner end edge 358 of the tray 304 (see, e.g., FIG. 11) therebetween and into the narrowed ends 354 of the slots 350. Accordingly, despite any misalignment between the side edges 346 of the tray 304 and the narrowed ends 354 of the slots 350, the angled surfaces 356 at the enlarged ends 352 of the slots may direct the tray therein.

Figure 14:
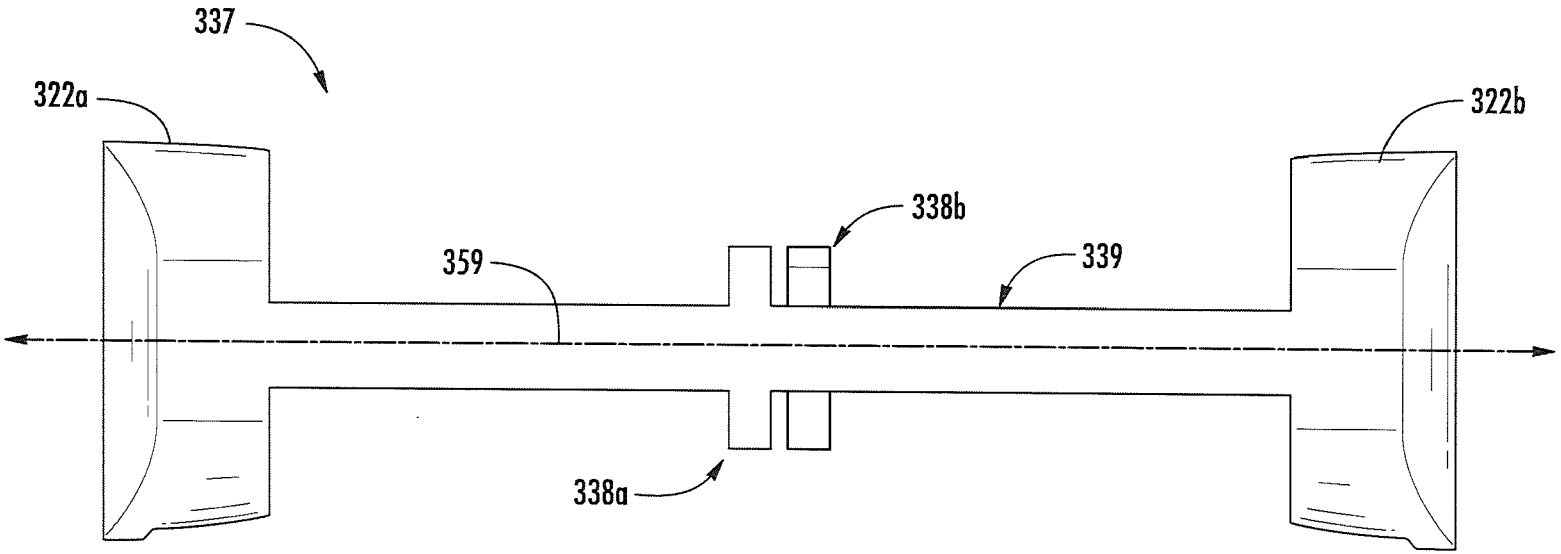
FIG. 14 illustrates a top view of the locking apparatus of the dispensing container of FIG. 10.

As the tray 304 is received in the chamber 336 and received in the slots 350 in the buttons 322, the inner end 358 of the tray 304 may contact the locking protrusions 338. As illustrated in FIG. 14, which is a top view of the locking apparatus 300, the locking protrusion 338*a* and the opposing locking protrusion 338*b* may be positioned such that they are displaced from one another along an axis 359 extending between the buttons 322. Accordingly, as illustrated in FIG. 15, the locking protrusion 338*a* and the opposing locking protrusion 338*b* may overlap one another in a direction 361 perpendicular to the axis 359 extending between the buttons 322 and perpendicular to the direction in which the tray 304 is received in the locking apparatus 300.

As illustrated in FIG. 13, the locking protrusions 338 may respectively comprise a front portion 368*a*, 368*b* (collectively, "front portions 368") defining an angled surface and a rear portion 370*a*, 370*b* (collectively, "rear portions 370") defining a surface that is substantially perpendicular to a direction in which the slots 350 in the buttons 322 extend. The angled surfaces at the front portions 368 of the locking protrusions 338 may be configured to contact the inner end edge 358 of the tray 304 and direct the tray between the locking protrusions.

Figure 15:
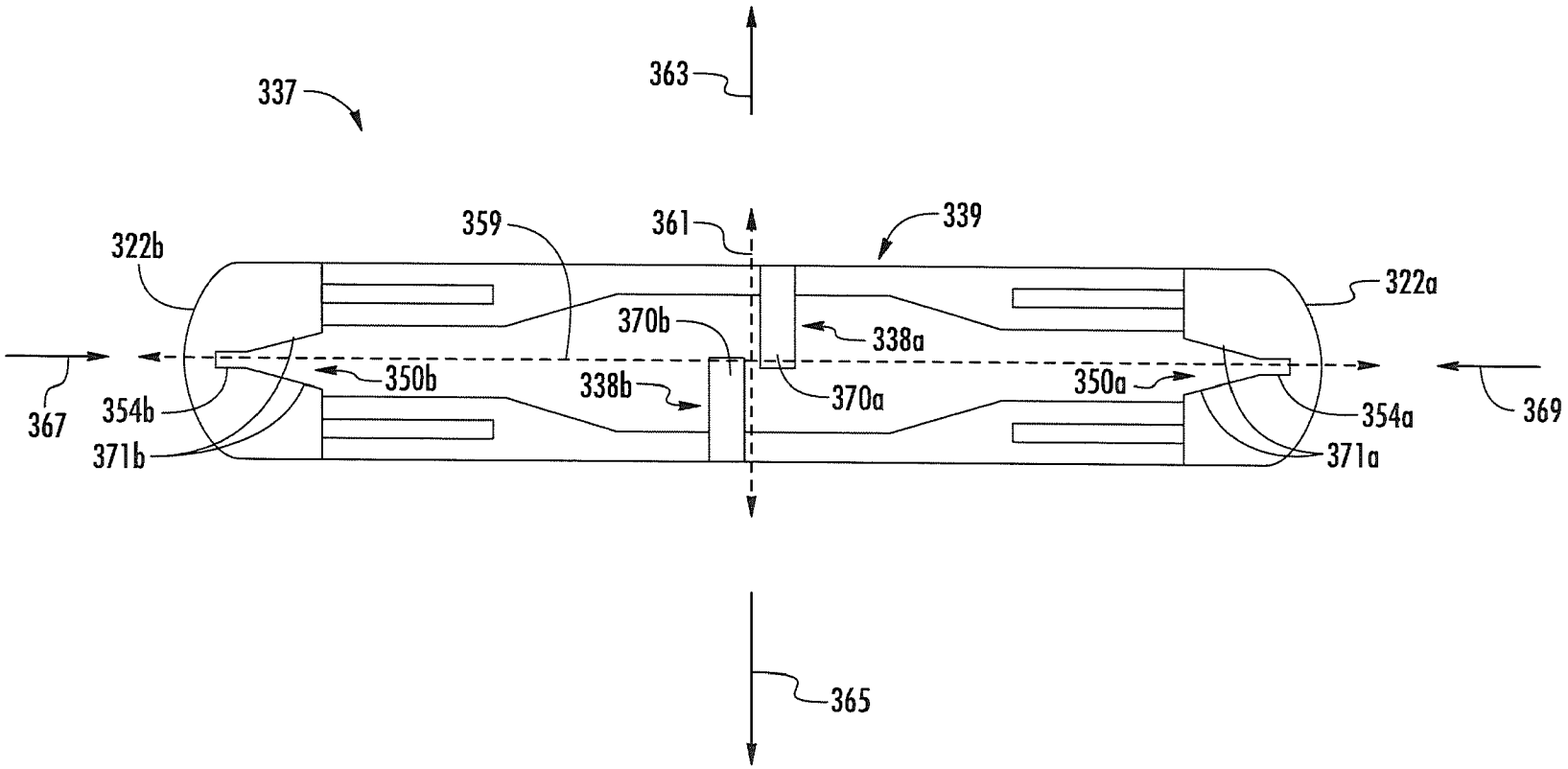
FIG. 15 illustrates a rear view of the locking apparatus of the dispensing container of FIG. 10.

Thereby, the support structure 339 may flex to allow the locking protrusions 338 to move apart from one another, as indicated by arrows 363, 365 in FIG. 15. As a result of being coupled to the support structure 339, the buttons 322 may move slightly toward one another, as indicated by arrows 367, 369 as the locking protrusions 338 move away from one another. As the tray 304 is pushed farther into the chamber 336, the locking protrusions 338 may be forced into engagement with the locking apertures 334. In this regard, as the locking protrusions 338 are moved apart from one another during insertion of the tray 304 therebetween, this may elastically deform the support structure 339. The elastic deformation of the support structure 339 may result in the creation of a spring force that directs the locking protrusions 338 into engagement with the locking apertures 334 when the locking apertures reach the tips of the locking protrusions.

Accordingly, the locking protrusions 338 may engage the locking apertures 334 and retain the tray 304 in a locked configuration. In the locked configuration movement of the tray 304 outwardly from the chamber 336 defined by the housing 318 of the dispensing container 302 may be resisted. More particularly, interference fit between the locking protrusions 338 and the locking apertures 334 may prevent, or at least resist, movement of the tray 304 outwardly from the dispensing container 302.

In this regard, whereas the front portions 368 of the locking protrusion 338 may define angled surfaces configured to allow the tray 304 to slide therebetween and into engagement the locking apertures 334, the rear portions 370 of the locking protrusions may define a surface that is substantially perpendicular to a direction in which the slots 350 in the buttons 322 extend. Further, the locking protrusions 338 may overlap one another in the direction 361 perpendicular to the axis 359 extending between the buttons 322 and perpendicular to the direction in which the tray 304 is received in the locking apparatus 300. Accordingly, the rear portions 370 of the locking protrusions 338 may be configured to prevent movement of the tray 304 out of the chamber 336, except when released as described below.

In this regard, the buttons 322 may be operatively engaged with locking protrusions 338 such that depressing the buttons toward the tray 304 (and one-another) moves the locking protrusions relative to the tray from the locked configuration in which the locking protrusions engage the locking apertures 334 in the tray to an unlocked configuration in which the locking protrusions release from the apertures in the tray and the tray may be at least partially slid out from the housing 318. In this regard, the support structure 339 may be configured to flex when the buttons 322 are depressed toward one another. More particularly, as illustrated in FIG. 12, the slots 350 may provide a gap 371*a*, 371*b* (collectively, "gaps 371") between the first button 322*a* and the first side edge 346*a* of the tray 304 and between the between the second button 322*b* and the second side edge 346*b* of the tray. Thereby, the buttons 322 may be depressed inwardly to the extent the gaps 371 allow.

As the buttons 322 are depressed inwardly in the directions illustrated by the arrows 367, 369 in FIG. 15, the support structure 339 may flex in the directions indicated by the arrows 363, 365 such that the locking protrusions 338 move apart from one another and away from the tray 304. In order to facilitate bending of the locking apparatus 337 during depression of the buttons 322, each button may define diverging surfaces 371*a*, 371*b* (collectively, "diverging surfaces 371") on opposing sides of the slots 350. For example, as illustrated in FIG. 15, the diverging surfaces 371 may be configured to transfer force applied inwardly (in the direction of arrows 367, 369) against the buttons 322 perpendicularly thereto (in the directions of arrows 363, 365) to cause the locking protrusions 338 to move away from one another. As illustrated in FIG. 12, in order to accommodate movement of the support structure 339, the housing 318 may define a clearance 373*a*, 373*b* (collectively, "clearances 373") between the support structure and first and second major sidewalls 342, 362 of the housing. Thus, the support structure 339 may flex as described above without the housing 318 interfering with movement thereof.

As the buttons 322 are depressed, the locking protrusions 338 may release from the locking apertures 334 in the tray 304 and the user may simultaneously grasp and pull the tray 304 outwardly from the housing 318 while the buttons are depressed. In some embodiments the buttons 322 must be simultaneously depressed and the tray 304 must be pulled outwardly therefrom with the buttons remaining depressed at least initially during the outward pulling motion to disengage the locking protrusions 338 from the locking apertures 334 in the tray, which may provide the packaged product assembly 300 with a degree of child resistance. Further, although not illustrated, the dispensing container 302 may comprise a stop protrusion as described above, which is configured to prevent the tray 304 from being fully removed from the housing 318.

Although the support structure 339 is described above as being separate from the housing 318, in another embodiment the support structure may be defined by a housing. In this regard, in some embodiments of the dispensing containers provided herein, the housing may be configured to flex when the buttons are depressed. In such an embodiment, by way of example, the buttons may also be integral with the housing.

Figure 16:
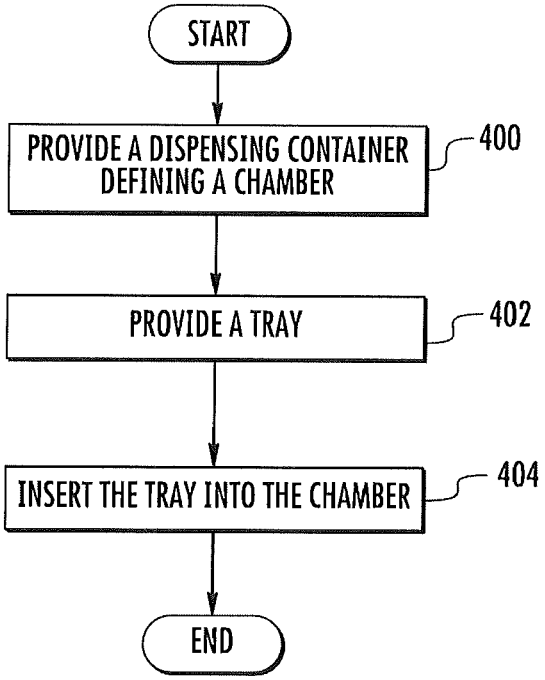
FIG. 16 schematically illustrates a method for lockably engaging a tray according to an example embodiment of the present disclosure.

Embodiments of related methods are also provided. In this regard, FIG. 16 illustrates an example embodiment of a method for lockably engaging a tray is provided. The method may comprise providing a dispensing container at operation 400. The dispensing container may comprise a housing defining a chamber, a locking protrusion extending within the chamber, and a first button and a second button positioned at opposing sides of the housing. The first button may define a first slot and the second button may define a second slot. The method may additionally include providing a tray at operation 402. The tray may define an aperture and a plurality of sealed cavities in which a plurality of units of a product are received. Further, the method may include inserting the tray into the chamber such that a first side edge of the tray is received in the first slot in the first button and a second side edge of the tray is received in the second slot in the second button and the locking protrusion engages the aperture in the tray at operation 404.

In some embodiments inserting the tray into the chamber at operation 404 may comprise sliding the tray along a sliding portion of a longitudinal extension extending into the chamber from a major sidewall of the housing. Inserting the tray into the chamber at operation 404 may also include bending the tray about the longitudinal extension and retaining the locking projection in a substantially stationary configuration. Further, inserting the tray into the chamber at operation 404 may comprise directing an end edge of the tray between the locking protrusion and an opposing locking protrusion. Inserting the tray into the chamber at operation 404 may additionally include flexing a support structure coupled to the first button, the second button, the locking protrusion while the locking protrusion and the opposing locking protrusion move apart from one another. Also, inserting the tray into the chamber at operation 404 may further comprise directing the first side edge and the second side edge of the tray between a plurality of rails configured to align the tray with respect to the first slot in the first button and the second slot in the second button.

Although the dispensing containers provided herein are generally described above as including a tray comprising a blister pack, various other embodiments of trays may be employed. In this regard, in other embodiments the tray may comprise a sliding container configured to partially or fully enclose units of product. Units of product may then be dispensed from the sliding container when the sliding container is moved to the unlocked, extended position. However, various other embodiments of trays may also be employed.

Many modifications and other embodiments of the disclosure will come to mind to one skilled in the art to which this disclosure pertains having the benefit of the teachings presented in the foregoing description; and it will be apparent to those skilled in the art that variations and modifications of the present disclosure can be made without departing from the scope or spirit of the disclosure. Therefore, it is to be understood that the disclosure is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An apparatus, comprising:

a locking protrusion configured to releasably engage an aperture in a tray;

a first button and a second button configured to receive the tray therebetween, the first button and the second button being operatively engaged with one of the locking protrusion and the tray such that depressing the first button and the second button inwardly toward the tray adjusts the engagement of the locking protrusion with the tray from a locked configuration in which the locking protrusion engages the aperture in the tray to an unlocked configuration in which the locking protrusion is disengaged from the aperture in the tray and the tray may be slid out from between the first button and the second button, wherein the first button defines a first slot configured to receive a first side edge of the tray and the second button defines a second slot configured to receive a second side edge of the tray.

2. The apparatus of claim 1, wherein the first slot and the second slot respectively define an enlarged end and a narrowed end.

3. The apparatus of claim 1, wherein depressing the first button and the second button inwardly toward the tray elastically bends the tray such that the aperture in the tray lifts off of the locking protrusion and disengages therefrom.

4. The apparatus of claim 1, wherein depressing the first button and the second button inwardly toward the tray moves the locking protrusion relative to the tray such that the locking protrusion releases from the aperture.

5. The apparatus of claim 4, further comprising an opposing locking protrusion configured to engage a second aperture in the tray.

6. The apparatus of claim 5, further comprising a support structure coupled to the first button, the second button, the locking protrusion, and the opposing locking protrusion, the support structure being configured to flex when the first button and the second button move toward one another such that the locking protrusion and the opposing locking protrusion move apart from one another.

7. The apparatus of claim 5, wherein the locking protrusion and the opposing locking protrusion are displaced from one another along an axis extending between the first button and the second button.

8. The apparatus of claim 7, wherein in the locked configuration the locking protrusion and the opposing locking protrusion overlap one another in a direction perpendicular to the axis extending between the first button and the second button.

9. The apparatus of claim 5, wherein the locking protrusion and the opposing locking protrusion define angled surfaces configured to contact an end edge of the tray and direct the tray between the locking protrusion and the opposing locking protrusion.

* * * * *